United States Patent [19]

Blenkarn et al.

[11] 4,431,059

[45] Feb. 14, 1984

[54] VERTICALLY MOORED PLATFORM ANCHORING

[75] Inventors: Kenneth A. Blenkarn; Pierre A. Beynet, both of Tulsa, Okla.

[73] Assignee: Standard Oil Company, Chicago, Ill.

[21] Appl. No.: 280,590

[22] Filed: Jul. 6, 1981

Related U.S. Application Data

[63] Continuation of Ser. No. 899,608, Apr. 24, 1978, abandoned.

[51] Int. Cl.[3] ..... B63B 21/50

[52] U.S. Cl. ..... 166/359; 166/366; 166/367; 175/7; 114/293

[58] Field of Search ..... 405/195-228; 166/350, 359, 367, 366; 114/264-266, 293-295, 230, 256; 441/4, 5; 175/5, 7

[56] References Cited

U.S. PATENT DOCUMENTS

| | | | |
|---|---|---|---|
| 2,607,422 | 8/1952 | Parks | 166/367 |
| 3,154,039 | 10/1964 | Knapp | 114/265 |
| 3,559,410 | 2/1971 | Blenkarn et al. | 405/203 |
| 3,559,411 | 2/1971 | Blenkarn | 405/225 |
| 3,572,272 | 3/1971 | Dixon et al. | 114/294 |
| 3,605,414 | 9/1971 | Westmoreland, Jr. | 405/224 |
| 3,648,638 | 3/1972 | Blenkarn | 114/265 |
| 3,705,623 | 12/1972 | Eek et al. | 166/338 |
| 3,721,292 | 3/1973 | Amlstone | 175/7 |
| 3,889,747 | 6/1975 | Regan et al. | 175/7 X |
| 3,917,006 | 11/1975 | Kellner | 175/27 |
| 3,971,576 | 7/1976 | Herd et al. | 175/7 X |
| 3,976,021 | 8/1976 | Blenkarn et al. | 114/265 X |
| 3,978,804 | 9/1976 | Beynet et al. | 405/224 |
| 3,983,828 | 10/1976 | Stram | 175/7 |
| 3,987,636 | 10/1976 | Hruska et al. | 405/227 X |
| 3,993,273 | 11/1976 | Dade | 405/195 |
| 4,062,313 | 12/1977 | Stram | 114/265 |
| 4,086,971 | 3/1978 | Hall | 175/7 |
| 4,127,005 | 11/1978 | Osborne | 405/227 |
| 4,130,995 | 12/1978 | Osborne | 405/224 |
| 4,188,156 | 2/1980 | Fisher | 166/367 |
| 4,216,834 | 8/1980 | Wardlaw | 405/224 |

*Primary Examiner*—Trygve M. Blix
*Assistant Examiner*—Thomas J. Brahan
*Attorney, Agent, or Firm*—John D. Gassett

[57] ABSTRACT

An improved system for anchoring a floating vessel which is anchored only by parallel and essentially vertical conduits. The anchoring load is carried by units of concentric pipes including an outer riser pipe and inner strings of casing. Drilling wells and/or production of oil and gas or like operations are conducted through these casings. The tension of the inner casing string is transmitted to the floating vessel through the upper end of the outer riser pipe. The system prevents excessive buildup of stresses in the upper end of the inner casing due to the bending caused by excursions caused by the waves, the wind and the current.

12 Claims, 4 Drawing Figures

VERTICALLY MOORED PLATFORM ANCHORING

This is a continuation of application Ser. No. 899,608, filed Apr. 24, 1978 now abandoned.

BACKGROUND OF THE INVENTION

1. Field of the Invention

This invention relates to a structure floating on a body of water. More particularly, the invention relates to a floating structure from which drilling wells and/or production of oil and gas or like operations, or both, are carried out. In its more specific aspects, the invention concerns a floating structure having buoyancy means to float the structure and in which the structure is anchored by a plurality of essentially parallel and vertical conduits commonly called "risers." More specifically, the invention concerns such a structure in which concentric casing strings, within riser pipes, form an important part of the anchoring system.

2. Setting

In recent years, it has become desirable to use a floating vessel from which to drill wells in marine locations. Many of these structures have been maintained on station by conventional spread catenary mooring lines, or by propulsion thruster units. One system of floating vessel receiving attention for drilling or production of wells in water is the Vertically Moored Platform, such as described in U.S. Pat. No. 3,648,638, issued Mar. 14, 1972, entitled "Vertically Moored Platform," Kenneth A. Blenkarn, inventor. A key feature of Vertically Moored Platforms is that the floating platform is connected to anchor means in the ocean floor only by elongated, parallel members which are preferred to be large diameter conduits, commonly called "riser pipes." These elongated members or riser pipes are held in tension by excess buoyancy of the platform.

3. Prior Art

This invention is an improvement over the anchoring system described in U.S. Pat. No. 3,648,638, supra. This patent is considered the closest prior art and, as stated above, our present invention is an improvement thereon. Other patents dealing with Vertically Moored Platforms include U.S. Pat. Nos. 3,559,410; 3,559,411; 3,572,272; 3,976,021; 3,978,804; 3,983,828; 3,993,273; 4,062,313; and 3,154,039. There are prior patents and art which teach to have concentric strings of casing extending from an underwater well to a platform above the water. In this latter regard, attention is directed to U.S. Pat. No. 3,971,576. U.S. Pat. No. 3,705,623 shows concentric pipes 33 and 17 connected to a buoyancy member 19; however, those concentric pipes form no part of the anchoring system. None of these patents or art to our knowledge teach to anchor a Vertically Moored Platform by means of concentric tensioned casing strings within an outer tensioned riser pipe. No prior art is known to do this.

BRIEF DESCRIPTION OF THE INVENTION

This invention concerns an anchoring system and method of connecting a vessel floating on a body of water to a subsea well having a first string of casing set and secured in a hole in the bottom of said body of water, and a second string of casing supported in the first string and extending deeper than said first string of casing and secured in said hole. A first riser conduit (commonly called a "riser pipe") is connected at its lower end to said first string of casing in a sealing relationship so that the first riser conduit and the first string of casing form a fluid-tight conduit. The upper end of said first riser conduit is supported from the vessel to apply a tension thereto. The lower end of a second riser conduit or riser casing is connected to the second string of casing in a sealing relationship so that said second string of casing and the second riser conduit form a second fluid-tight conduit. The upper end of the second riser conduit is supported from an upper portion of the first riser conduit such that a tension is applied to the second riser conduit when tension is applied to the first riser conduit.

The upper and lower ends of the first riser conduit (or riser pipe) are provided with terminators which are really stiffened sections of the riser pipe to distribute curvature over a length or a portion of the length of the riser pipe. The second or inner riser conduits are provided with centralizers within the outer or first riser conduit terminators. The upper and lower ends of the inner casing strings need no terminators.

Various objects and a better understanding of the invention can be had from the following description taken in conjunction with the drawings.

DETAILED DESCRIPTION

Figure 1:
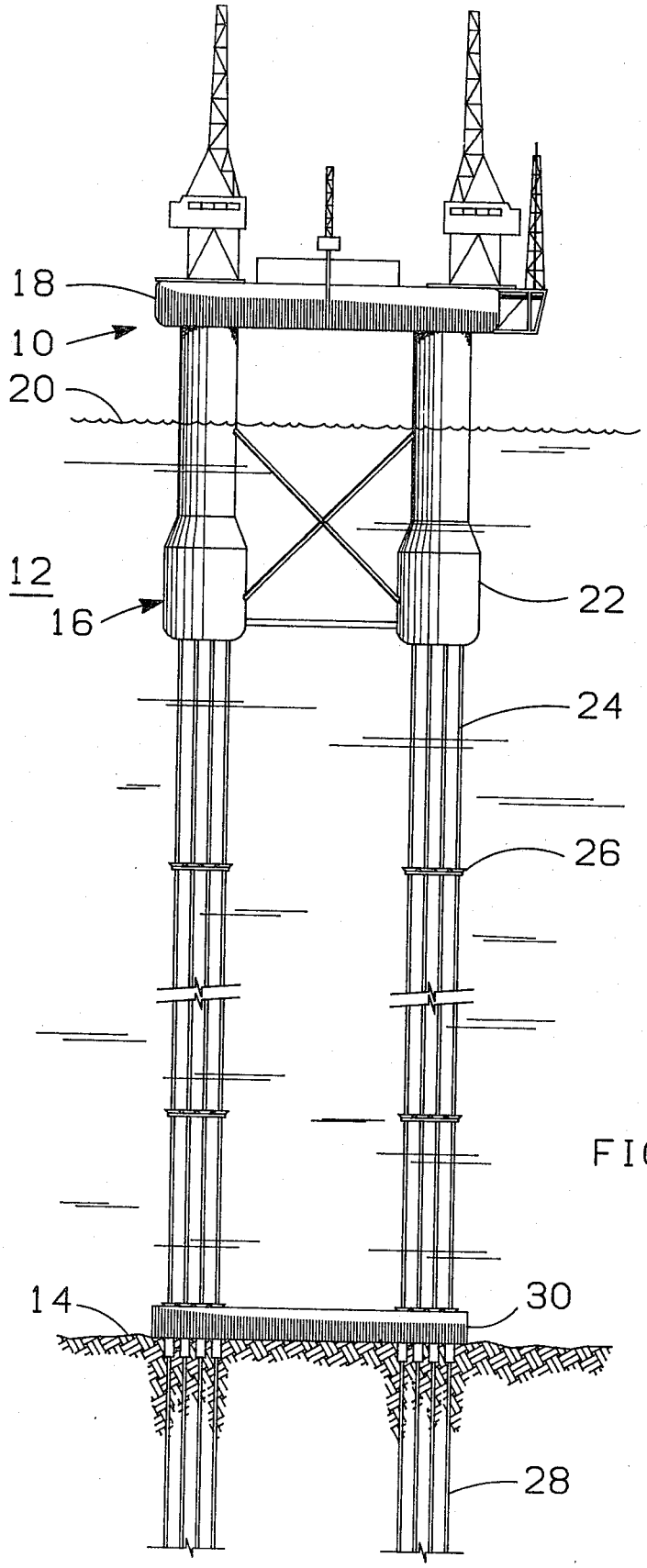
FIG. 1 is a view of a Vertically Moored Platform.

Reference is first made to FIG. 1 which shows a side view of a Vertically Moored Platform. Shown therein is a platform 10 supported on a body of water 12 having a bottom 14. The structure 10 generally includes a float means 16 which supports a working deck 18 above the surface 20 of the body of water 12. It is to be noted that a Vertically Moored Platform is described in detail in prior U.S. Pat. No. 3,648,638, supra. Float means 16 is, for example, composed of four bottle-shaped buoyant legs 22. Each leg 22 is anchored by a plurality of riser pipes 24 which are provided with spacers 26. Riser pipes 24 connect to casings 28 which are cemented in holes in the bottom of the body of water. A template 30 is shown on the bottom 14 through which the wells for casings 28 were guided. Riser pipes 24 normally are made of high quality steel and typically are 20 inches in diameter. The riser pipes 24 are parallel and are held in tension by the vertical force exerted on the buoyant structure. The typical length of these riser pipes 24 may be from 500 feet up to several thousand feet from the base of the leg member 22 of the Vertically Moored Platform to the sea floor 14.

Figure 2:
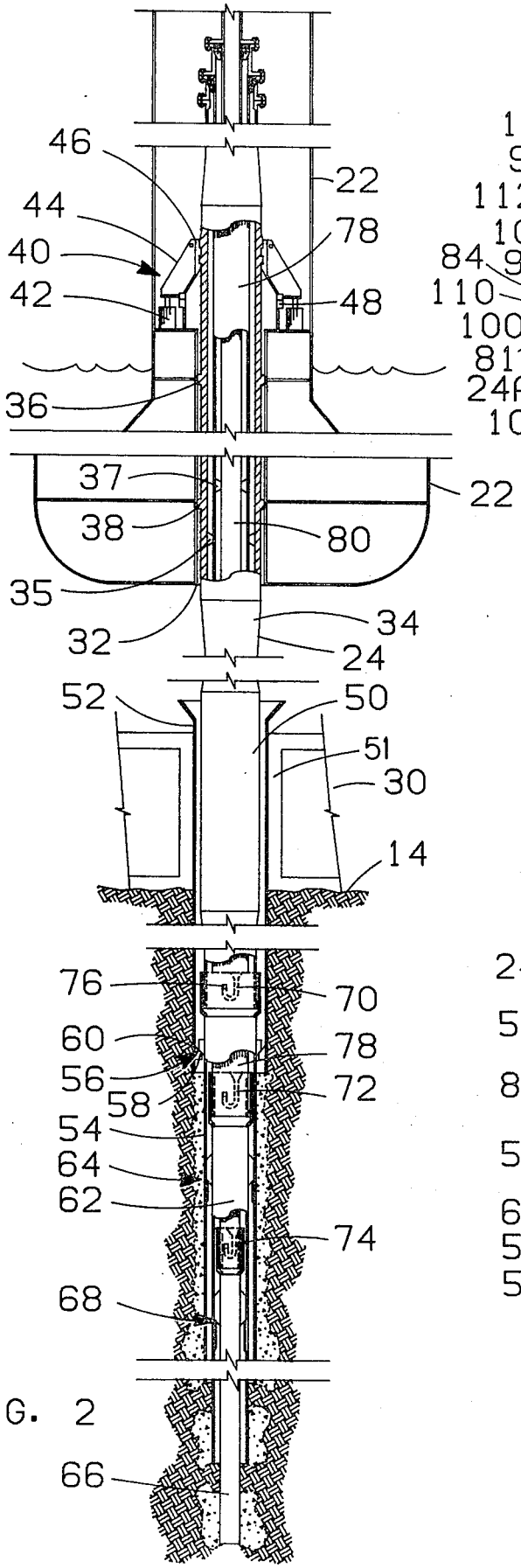
FIG. 2 illustrates, partly in cutaway view, one riser pipe means of one leg of the Vertically Moored Platform of FIG. 1.

Attention is next directed to FIG. 2 which illustrates an improved anchoring connection means between the Vertically Moored Platform and the sea floor. Shown thereon is leg 22 which is one of the four float members of the Vertically Moored Platform of FIG. 1. For simplicity and ease of understanding, we have shown only one riser pipe means extending between the leg 22 and the sea bottom 14. A vertical passage 32 extends through the lower part or enlarged portion of leg 22.

The upper end of riser pipe 24 is provided with an upper riser terminator 34. As a word of explanation, it is known that if a tubular member is held under tension and subject to bending, stresses concentrated in the ends. One way of meeting this problem is to make the end section sufficiently strong to distribute the bending deformation which may concentrate therein over a longer length. This is what is done here and we call the strengthened portion "a terminator," in this case, "the upper riser terminator 34." Thus, a terminator is a stiffened section of riser pipe to distribute curvature over a selected portion of the riser pipe.

Upper horizontal bearings 36 and lower horizontal bearings 38 are provided between upper terminator 34 and the wall of passage 32 through jacket 22. Above the horizontal bearing 36 is a vertical bearing means 40. Details of this vertical bearing 40 are shown in U.S. Pat. No. 3,976,021, FIGS. 17 and 18. It includes primarily a jack 42, bracket 44, engaging shoulders 46 of the upper end of the upper riser terminator 34, and shims and bearings 48. The vertical force of the tension in riser pipe 24 is transmitted through vertical bearing 40 to the Vertically Moored Platform jacket 22.

The lower end of riser pipe 24 is connected to a lower terminator 50 which passes through a drive pipe 52 in template 30. A 20-inch conductor casing 54 is hung from drive pipe 52 through mudline suspension 56, which in reality may be a upwardly facing shoulder 58 on drive pipe 52, and a shoulder 60 having a downwardly facing shoulder attached to the outer wall of 20-inch conductor casing 54. If the bottom 14 is sufficiently soft, drive pipe 52 can be driven the required depth into the bottom 14; otherwise, a hole can be drilled through the guide tube. A hole can be drilled through drive pipe 52 and the 20-inch conductor casing 54 set and cemented in place using conventional sea-drilling equipment.

After the 20-inch casing has been cemented in place, a smaller diameter hole to accommodate the next smaller size of casing can be drilled in the bottom thereof. This may be a $13\frac{5}{8}$ inch casing, which is illustrated as intermediate casing 62, which is supported by mudline suspension 64, which is similar to mudline suspension 56. The second or $13\frac{5}{8}$ inch intermediate casing 62 is then run and cemented in place. Then, the $13\frac{5}{8}$ intermediate riser conduit 78 is run and connected to casing 62. After this, an additional hole is drilled to accommodate the next smaller size of casing, which may be $9\frac{5}{8}$. The innermost casing 66 is run and cemented in place and is suspended by mudline suspension 68. Any desired number of casing strings may be set in place in drilled holes in a manner described above which is well known. The upper ends of each of casings 54, 62, and 66 are provided with a locking means, such as J-slots 70, 72, and 74.

The lower end of riser pipe 24 is connected to the upper end of conductor casing 54 by a J-lug 76 which fits into the J-slot 70. Sealing means are also provided so that a fluid-tight conduit is formed from the conductor casing 54 upwardly to the floating structure as exemplified by jacket 22. Latching means, not shown, between conductor casing 54 and drive pipe 52 can be installed to restrain vertical movement between conductor casing 54 and drive pipe 52. A similar device can be installed for succeeding pairs of casing strings such as casing 62 and 66.

Within riser pipe 24 are shown two concentric strings of casing, an intermediate riser conduit 78 and the innermost riser conduit 80. Of course, any reasonable number of inner casing strings can be used. The lowermost end of intermediate riser conduit 78 is connected through J-slot 72 to the cemented casing 62 in the borehole, and, likewise, the lower end of innermost riser conduit 80 is connected to the cemented innermost casing 66, which is shown as the smaller one in the drawing. Thus, we have a casing 62 and intermediate riser conduit 78 forming a fluid-tight conduit extending from the bottom of the casing to the top of the intermediate riser conduit 78; likewise, a smaller fluid-tight conduit is formed from the lower end of the innermost casing 66 through riser conduit 80 to the top of the platform. If desired, intermediate riser conduit 78 can be run before the hole for the inner casing 66 is drilled.

Figure 4:
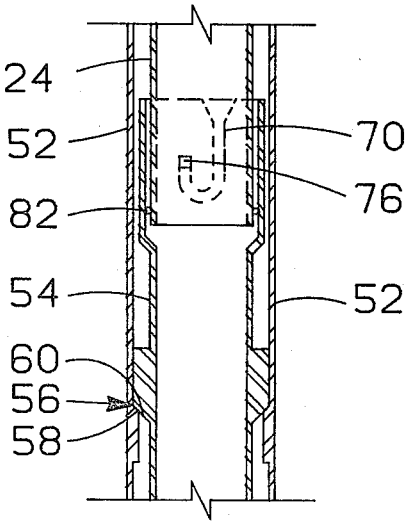
FIG. 4 shows one means of connecting the riser pipe to the string of casing anchored in the wellbore.

The connecting arrangement between the riser pipe and the casing set in the wellbore is shown in FIG. 4. Shown thereon also is the J-slot 70 on the upper end of the enlarged end portion of conduit casing 54 and a J-lug 76, which is on the lower end of riser 24. Seal means 82 are provided between the lower end of riser 24 and the enlarged portion of the upper end of conduit casing 54. Connection 72 for intermediate riser conduit 78 and cemented casing 62 and connection 74 for innermost riser conduit 80 and cemented casing 66 can be like that shown in FIG. 4.

Figure 3:
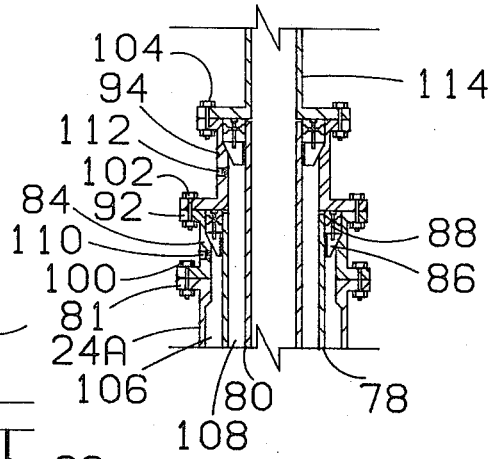
FIG. 3 illustrates an enlarged cross-sectional view of the means of FIG. 2 of connecting the top ends of the inner casing strings to the riser pipe.

Attention is now directed to means for supporting the upper end of intermediate riser conduit 78 and innermost riser conduit 80 to the upper end of the riser pipe such that the inner riser conduits 78 and 80 form a part of the anchoring system. This is shown clearly in FIG. 3. The upper end of riser pipe extension 24A is provided with a flange 81. A casing hanger spool 84 is provided to sit on top of flange 81. Means are provided to connect the casing hanger spool 84 to the intermediate riser conduit 78. This includes a slip means 86. Screw 88 is used to set a seal of the annulus between casing 78 and casing hanger spool 84. Thus, the upper end of intermediate riser conduit 78 is supported from riser extension 24A through casing hanger spool 84. Casing hanger spool 84 has an upper flange 92 which supports casing hanger spool 94; thus, innermost casing string 80 is supported from riser extension 24A through casing hanger spools 84 and 94. Bolts 100, 102, and 104 with proper machining and sealing are provided to assure fluid-tight annular spaces 106 between riser extension 24A and riser conduit 78 and annulus 108 between the two inner riser conduits 78 and 80. Plugs 110 and 112 may be removed and pressure gauges installed to determine the pressure in these annuli. Conventional valves and other equipment may be placed on extension 114 in which to produce the well drilled through these casings.

The preferred installation procedure is to first pretension the riser 24 to a predetermined value with the jack 42 and then shim it in place on bearing 48. The hole for the casing 62 is drilled. The casing 62 is run and cemented in. The intermediate riser conduit 78 is run and latched to intermediate 62 at the J-slot 72; then, the casing riser conduit 78 is tensioned with the draw work of the drilling rig to a predetermined value which is a function of the riser 24 tension. The locking means 86 is set, locking the upper end of intermediate riser conduit 78 to casing hanger spool 84. Other inner strings are installed in a similar manner.

Within riser 24 and riser terminators 34 and 50, we have provided centralizers 35 between the riser 24 and terminators 34 and 50 and the first or intermediate riser conduits 78 and centralizers 37 between riser conduits 78 and 80. By thus doing so, we control the frictional wear caused by the relative motion between the two strings. Also, the casing string, being inside the riser, does not require a terminator.

By the system that we have just described, a substantial part of the mooring is by the riser conduits 78 and 80. This provides a much stronger anchoring means for a given size of riser pipe and will afford more protection in the event of a very severe storm. The amount of mooring by the outer riser pipe 24 compared to the inner casing riser conduits 78, 80, etc., is a function of the cross-sectional area or, more accurately, a function of their respective axial flexibility. The part of the mooring carried by the riser conduits may vary from as low as about 25% to about 70% of the total mooring forces.

An example of where the riser conduits carry 27% of the mooring force in calm water is:

Riser (24): 18⅝" OD 0.625" W.T., 610 kips
Riser Conduit (78): 9⅝" OD 0.352" W.T., 128 kips
Riser Conduit (80): 7" OD 0.272" W.T., 72 kips
Tubing Riser: 2⅞" OD 0.217" W.T., 23 kips
Note: A KIP is 1000 pounds.

An example of where the riser conduit carry 45% of the mooring force in calm water is:

Riser: 18⅝" OD 0.625" W.T., 455 kips
Riser Conduit: 13⅜" OD 0.380" W.T., 144 kips
Riser Conduit 9⅝" OD 0.472" W.T., 126 kips
Riser Conduit: 7" OD 0.453" W.T., 86 kips
Tubing: 2⅞" OD 0.276" W.T., 21 kips An example of where the casing risers carry 60% of the mooring force in calm water is:

Riser: 18⅝" OD 0.625" W.T., 460 kips
Riser Conduit: 13⅜" OD 0.380" W.T., 208 kips
Riser Conduit: 9⅝" OD 0.972" W.T., 239 kips
Conduit Riser: 7" OD 0.276" W.T., 194 kips
Tubing Riser: 2×2⅜" OD 0.190" W.T., 45 kips An example of where the casing risers carry 67% of the mooring force in calm water is:

Riser: 18⅝" OD 0.625" W.T., 460 kips
Riser Conduit: 13⅜" OD 0.719" W.T., 383 kips
Riser Conduit: 9⅝" OD 0.545" W.T., 271 kips
Riser Conduit: 7" OD 0.54" W.T., 231 kips
Tubing Riser: 2×2⅜" OD 0.218" W.T., 60 kips These distributions are determined by the axial flexibility of the riser strings and by the expected temperature and pressure effect. They will change when the temperature and the pressure distribution between each string vary. They will also change when the total mooring force changes under the influence of the wind, the waves, and the current.

While the above embodiments have been described in great detail, it is possible to incorporate variations therein without departing from the spirit or scope of the invention.

We claim:

1. A method of anchoring a vessel floating on a body of water to a subsea well having a first string of casing set and secured in a hole in the bottom of said body of water, a second string of casing supported within said first string and extending deeper than said first string and secured in said hole and a third string of casing supported within said second string and extending deeper than said second string and secured in said hole which comprises:

connecting a first riser conduit at its lower end to said first string of casing in sealing relationship so that said first riser conduit and said first string of casing form a fluid-tight conduit;

supporting the upper end of said first riser conduit from said vessel to apply tension thereto;

connecting the lower end of a second riser conduit to said second string of casing;

applying tension to said second riser conduit from tension means supported by said vessel and connected to the upper end of said second string of casing;

securing the upper end of said second riser conduit while under tension to an upper portion of said first riser conduit;

disconnecting said second riser conduit from said tension means;

connecting the lower end of a third riser conduit to said third string of casing;

applying tension to said third riser conduit from tension means supported by said vessel and connected to the upper end of said third string of casing;

securing the upper end of said third riser conduit while under tension to an upper portion of said first riser conduit; and disconnecting said third riser conduit from said tension means.

2. A method of anchoring a vessel floating on a body of water to a subsea well having a first string of casing set and secured in a hole in the bottom of said body of water and a second string of casing supported within said first string and extending deeper than said first string and secured in said hole which comprises:

connecting a first riser conduit at its lower end to said first string of casing in a sealing relationship so that said first riser conduit and said first string of casing form a fluid-tight conduit;

supporting the upper end of said first riser conduit from said vessel;

applying an upward force to the upper end of said first riser conduit to apply a tension thereto whereby said first string of casing resists said upward force;

connecting the lower end of a second riser conduit to said second string of casing in a sealing relationship so that said second string of casing and said second riser conduit form a second fluid-tight conduit;

supporting the upper end of said second riser conduit from said vessel and applying a second upward force to said second riser conduit from the buoyancy of said vessel whereby said second string of casing resists said second upward force;

performing drilling and production operations through said second riser conduit while maintaining tension on said first and second riser conduits; and there being no anchoring means for said vessel other than riser conduits.

3. A method as defined in claim 2 including supporting said second riser conduit from the upper end of said first riser conduit at a point above the level on said first riser conduit at which said first riser conduit is supported from said vessel.

4. A method as defined in claim 2 wherein the axial tension applied to all tensioned conduits within said first riser conduit is in the range of about 25% and about 70% of the total axial tension carried by said first riser conduit and all tensioned conduits within said first riser conduit.

5. A system for anchoring a vessel floating on a body of water to a plurality of concentric casings anchored in the floor of the body of water which comprises:

a tensioned first riser conduit;

a rigid vertical support bearing connecting an upper end portion of said first riser conduit to said vessel;

a horizontal bearing between an upper end portion of said first riser conduit and said vessel to transmit horizontal forces therethrough;

a second tensioned riser conduit within said first riser conduit and connected at its lower end to an anchor means in the floor of said body of water; and support means supporting said second riser conduit from said vessel.

6. A system as described in claim 5 in which a portion of the upper end of the riser conduit extending through the horizontal bearing is a terminator.

7. A system as described in claim 6 including a centralizer on said riser conduit within said terminator, the wall of said second riser conduit being of about uniform thickness along its entire length.

8. A system for anchoring a vessel floating on a body of water to a plurality of concentric casings anchored in the floor of the body of water which comprises:

a tensioned first riser conduit;

a rigid vertical support bearing connecting an upper end portion of said first riser conduit to said vessel;

a horizontal bearing between an upper end portion of said first riser conduit and said vessel to transmit horizontal forces therethrough;

a second tensioned riser conduit within said first riser conduit and connected at its lower end to one of said concentric casings; and support means supporting said second riser conduit from said first riser conduit at a level above said vertical support bearing.

9. A method of anchoring a vessel floating on a body of water to a plurality of subsea wells, each such well having (a) a first string of casing secured in a hole in the bottom of said body of water, (b) a second string of casing supported within each said first string and extending deeper than said first string and secured in each said hole, and (c) a third string of casing supported within each said second string and extending deeper than said second string and secured in said hole, which comprises:

connecting a first riser conduit at its lower end to each of said first string of casing in a sealing relationship so that each said first riser conduit and each said first string of casing form a fluid-tight conduit;

pulling on the upper end of each first riser conduit from said vessel to apply tension thereto;

placing a second riser conduit inside each said first riser conduit;

connecting the lower end of each said second riser conduit to one of said second string of casing;

applying tension to each said second riser conduit from tension means supported by said vessel and connected to the upper end of each said second riser conduit;

securing the upper end of each said tensioned second riser conduit to an upper portion of one of said first riser conduits;

then disconnecting each said second riser conduit from said tensioning means;

placing a third riser conduit inside each said second riser conduit;

connecting the lower end of said third riser conduit to a third string of casing;

applying tension to each said third riser conduit from tensioning means supported by said vessel and connected to the upper end of a third riser conduit;

disconnecting each said third riser conduit from said tensioning means;

producing fluid from each subsea well through each said third riser conduit while under tension, and there being no anchoring means for said vessel other than concentric riser conduits.

10. A method of anchoring a vessel floating on a body of water to anchor means having means for connecting to at least two riser conduits and being secured at the bottom of said body of water which comprises:

connecting a first riser conduit at its lower end to said anchor means;

supporting the upper end of said first riser conduit from said vessel;

applying a first upward force to the upper end of said first riser conduit to apply tension thereto whereby said anchor means resists said first upper force;

placing a second riser conduit within said first riser conduit;

connecting the lower end of said second riser conduit to said anchor means;

supporting the upper end of said second riser conduit from said vessel and applying a second upward force to said second riser conduit whereby said anchor means resists said second upward force;

performing operations through said second riser conduit while maintaining tension on said first and second riser conduits.

11. A system for anchoring a vessel floating on a body of water to an anchor means having a first and second connector positioned at the floor of the bottom of a body of water which comprises:

a tensioned first riser conduit connected at its lower end to said first connector of said anchor means;

first support means connecting said first riser conduit to said vessel to transmit vertical and horizontal forces therethrough;

a second tensioned riser conduit within said first riser conduit and connected at its lower end to said second connecter of said anchor means in the floor of said body of water and second support means supporting said second riser conduit from said vessel through said first riser conduit.

12. A system for anchoring a vessel floating on a body of water to a plurality of concentric casings anchored in the floor of a the body of water which comprises:

a tensioned first riser conduit connected at its lower end to one of said concentric casings;

a rigid vertical support bearing connecting an upper end portion of said first riser conduit to said vessel;

a horizontal bearing between an upper end portion of said first riser conduit and said vessel to transmit horizontal forces therethrough;

a second tensioned riser conduit within said first riser conduit and connected at its lower end to another of said concentric casings, and, support means supporting said second riser conduit from said vessel.

* * * * *